United States Patent [19]

Mathews

[11] 4,175,343

[45] Nov. 27, 1979

[54] NEEDLEWORK STAND

[76] Inventor: Margaret R. Mathews, Rte. 3, Box 485, Cut-in-Shoot, Tex. 77302

[21] Appl. No.: 854,705

[22] Filed: Nov. 25, 1977

[51] Int. Cl.[2] ..... D06C 3/08

[52] U.S. Cl. ..... 38/102.1; 269/51; 289/18.1

[58] Field of Search ..... 269/321 WE, 321 W, 50, 269/71, 75, 76, 257, 51; 248/454, 460, 413, 125, 122, 448; 223/106; 38/102.1-102.41; 289/1.5, 18; 28/149-152; 160/378

[56] References Cited

U.S. PATENT DOCUMENTS

| | | | |
|---|---|---|---|
| 1,380,573 | 6/1921 | Manley | 269/50 |
| 1,643,737 | 9/1927 | Benson | 269/157 |
| 2,019,789 | 11/1935 | Mahannah | 269/71 |
| 2,669,958 | 2/1954 | Sweeney | 269/76 |
| 3,048,387 | 8/1962 | Waggoner | 269/51 |
| 3,826,483 | 7/1974 | Siegel | 269/321 WE |
| 3,955,722 | 5/1976 | Bard | 248/125 X |

*Primary Examiner*—Robert C. Watson
*Attorney, Agent, or Firm*—Vinson & Elkins

[57] ABSTRACT

A needlework stand for holding rectilinear needlework stretcher frames at any desired work position is disclosed, including a base, a bracket for releasable attachment of the needlework stretcher frames and support for mounting the bracket on the base, the support including provision for universal angular positioning and vertical adjustment of the stretcher frame relative to the base. This abstract is not to be construed in any way to define or limit the invention set forth below.

3 Claims, 3 Drawing Figures

NEEDLEWORK STAND

This application relates to a needlework stand and more particularly to a stand for mounting the type of rectilinear stretcher frames used in performing needlepoint embroidery. In needlepoint (including quick-point, gros-point and petit-point) and similar types of embroidery, a relatively heavy backing material is mounted on a square or rectangular wooden stretcher frame which is then manually held and positioned as the threads forming the design are laced into the backing material.

Most embroidery work of this type is performed while in a sitting position, and frames for conveniently mounting and positioning the work-piece stretcher frame relative to a sitting person would provide an added convenience. However, during the progress of the work, it is essential that the stretcher frame be capable of universal angular positioning relative to the person performing the embroidery. While this is relatively easily accomplished by manual positioning of a frame held or supported by the hand, there has not heretofore been provided a needlework stand which possesses the necessary features.

It is accordingly, the principal object of the present invention to provide a floor mounted needlework stand which may be used to conveniently position a rectilinear needlework stretcher frame at any desired height and angular position relative to a person performing the needlework.

Another object is to provide such a frame which includes provision for releasable attachment of a wide range of the various sizes of needlework stretcher frames commercially available.

A further object is to provide such a stand which includes universal joint means and vertical adjustment means for selectively positioning the needlework stretcher frame at any desired height and angle, and which includes means for rigidly supporting the stretcher frame at such desired height and angle once so positioned.

A still further object is to provide such a frame which is relatively simple and inexpensive to manufacture and which may be manufactured from universally available and inexpensive materials and components.

These and other objects and advantages of the invention will be apparent from the following specification drawings and claims. In the accompanying drawings, in which like numerals indicate like parts:

Figure 1:
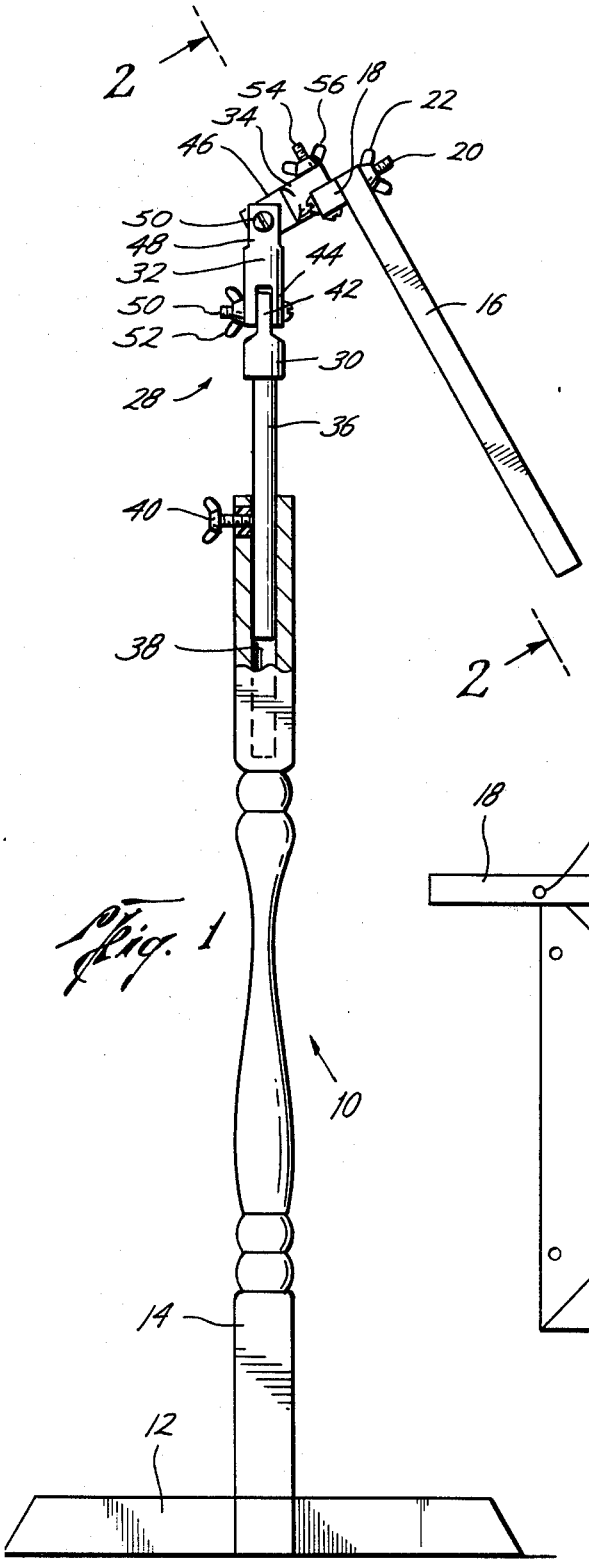
FIG. 1 is a view in side elevation, and partially in section, of a needlework stand constructed in accordance with the present invention.
Figure 3:
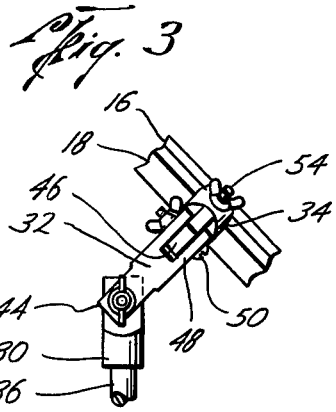
FIG. 3 is a detailed view illustrating a slot and tenon pivot joints of the stand.
Figure 2:
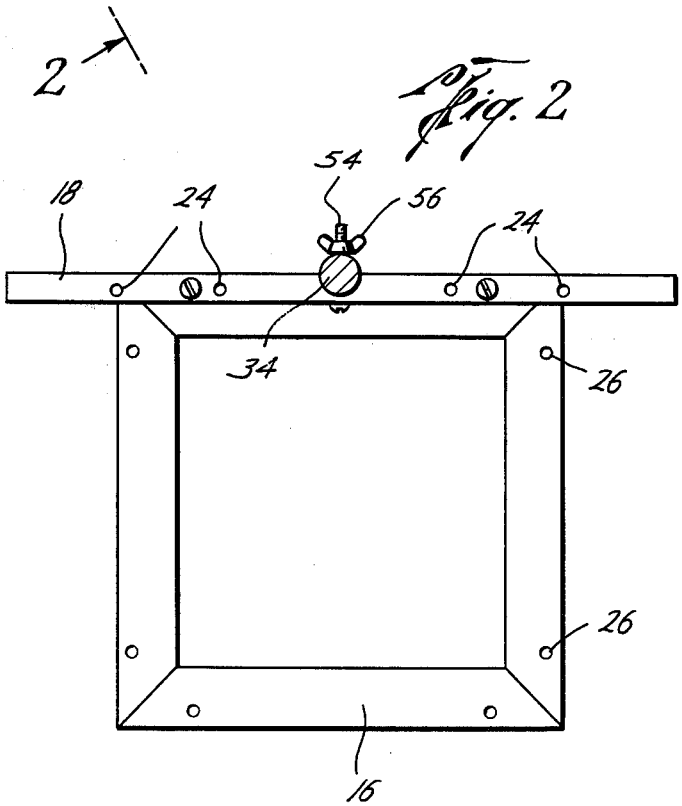
FIG. 2 is a view taken along line 2—2 of FIG. 1 and illustrating the needlework stand mounting bracket.

Referring now to the drawings, there is illustrated the needlework stand according to the present invention. It includes base means 10, having a suitable footing 12 for supporting the stand on a floor and a central upright member or post 14.

The rectilinear needlework stretcher frame 16 is releasably mounted on the mounting bracket 18 by means of bolts 20 and wing-nuts 22. The bolts 20 pass through mating holes 24 in the mounting bracket and 26 in the stretcher frame. A plurality of holes 24 are provided in the mounting bracket 18 so as to accomodate a variety of sizes of stretcher frame 16.

In the use of the needlework stand, it is desired that the stretcher frame 16 be selectively positionable at any desired height and angular relationship to the base 10 and that, once so positioned, the parts be locked or rigidly retained in their relative positions until released and moved to new positions. In the preferred embodiment, this is accomplished by providing support means 28 for supporting the mounting bracket 18 from the base 10 and including in the support means 28 lockable vertical adjustment means and lockable universal joint means, whereby the needlework stretcher frame 16 may be selectively rigidly positioned at any desired height and angle with respect to the base means 10. To accomplish this, the support means 28 includes a plurality of pivoted joints and a telescoping connection which, taken together, provide the desired adjustability.

As illustrated, the support means 28 comprise three pivotally interconnected pieces or members 30, 32 and 34 which are preferably made of wood, but may, of course, be made of any desired material. The lowermost piece 30 has provided at its lower end a vertical, cylindrical projection 36 which telescopes into a corresponding vertical, cylindrical bore 38 in the upper end of the base post 14. The cylindrical projection 36 may be selectively telescoped into the bore 38 to provide the desired vertical adjustment feature and may be pivoted or swiveled circumferentially about its longitudinal axis to provide desired rotational adjustment of the stretcher frame 16 relative to the base 10. Manually operable screw means 40 are provided in the base 10 for binding the projection 36 against the wall of the bore 38 to thereby lock or rigidly retain the support means 28 and stretcher frame 16 into the desired vertical and circumferential position relative to the base means 10.

The upper end of support means member 30 terminates in a tenon 42 which mates with a slot defined by ears 44 in the adjoining support member 32 to thereby provide a first pivoted connection in the support member 28. A second pivoted connection is provided at right angles to the first pivoted connection by tenon 46 formed on the third support member 34 which mates with a slot formed by ears 48 on the upper end of support member 32. Manually operable screw means, comprising bolts 50 and wing-nuts 52 provide manually operable screw means for locking the pair of slot-and-tenon pivot joints in the desired angular positions. An additional bolt 54 and wing-nut 56 provide means for releasably attaching the mounting bracket 18 to the upper-most support member 34.

With the apparatus as disclosed, it is thus possible to universally position the needlework stretcher frame 16 at any desired height, circumferential angle and angle of inclination with regard to the base means 10 and to releasably lock the stretcher frame 16 in such position until it is released and moved to a new work position. It is of course apparent that the terms "lock", "lockable" and "rigid", used in describing the action of the manually operable screw means for binding the various pieces in their relative positions, are used in a relative sense; the degree of rigidity obtained will be a direct result of the amount of force utilized in tightening the screw means into position, and some movement of the parts relative to each other will always be possible depending upon the degree of force exerted.

The above and foregoing disclosure and description of the invention is illustrative and explanatory thereof only, and various changes in the size, shape and materials of construction may be made within the scope of the appended claims without departing from the spirit of the invention.

What is claimed is:

1. A stand for holding needlework stretcher frames comprising:

base means for supporting said stand in a free standing position;

bracket means comprising an elongated bar provided with a plurality of openings for selectively releasably attaching needlework stretcher frames of various sizes;

support means for supporting said bracket means from the upper end of said base means, said support means including lockable vertical adjustment means and lockable universal joint means, whereby said needlework stretcher frame may be selectively rigidly positioned at any desired height and angle with respect to said base means.

2. The apparatus according to claim 1 wherein said lockable vertical adjustment means and lockable universal joint means comprise:

a vertical cylindrical projection on one of said base means and said support means and a mating bore on the other of said base means and said support means, whereby said projection may be selectively telescoped into said bore for vertical adjustment and may be swiveled about its vertical axis for rotational adjustment;

manually operable screw means for binding said projection in said bore to thereby lock said support means at any desired vertical and circumferential position relative to said base means;

a pair of slot and tenon pivot joints in said support means for permitting angular adjustment of said bracket and said needlework stretcher frame thereon relative to said base means;

manually operable screw means for locking each of said slot and tenon pivot joints at any desired position to thereby rigidly support said bracket and needlework stretcher frame thereon at any desired angular position with respect to said base means.

3. The stand according to claim 1 comprising additionally a wooden needlework stretcher frame having openings therein corresponding to the openings in said bracket means; and manually operable screw means adapted to pass through said corresponding openings in said stretcher frame and said bracket means for releasably attaching said stretcher frame to said bracket means.

* * * * *